US006058543A

United States Patent [19]

Thompson

[11] Patent Number: 6,058,543

[45] Date of Patent: May 9, 2000

[54] SHOWER HEAD CLEANING ATTACHMENT

[76] Inventor: Cora Ann Thompson, 3221 Cyanne Cir., Raleigh, N.C. 27606

[21] Appl. No.: 09/209,626

[22] Filed: Dec. 11, 1998

[51] Int. Cl.[7] ..... A46B 13/04; A46B 11/00

[52] U.S. Cl. ..... 15/29; 401/42; 401/43; 401/289

[58] Field of Search ..... 15/22.1, 24, 29, 15/205.2; 401/42, 43, 268, 289

[56] References Cited

U.S. PATENT DOCUMENTS

| | | | |
|---|---|---|---|
| 1,604,500 | 10/1926 | Tannenbaum | 15/29 |
| 3,638,264 | 2/1972 | Walton | 15/29 X |
| 4,335,481 | 6/1982 | Slayman | 15/29 |
| 5,649,334 | 7/1997 | Henriquez et al. | 15/29 |
| 5,913,982 | 6/1999 | Phillips | 15/29 X |
| 5,987,682 | 11/1999 | Rossi | 15/24 |

*Primary Examiner*—Mark Spisich

[57] ABSTRACT

A new shower head cleaning attachment for attachment to a shower head to permit cleaning therewith of a bathtub or shower stall. The inventive device includes a scrubbing brush with an elongate portion and an agitating head with a plurality of outwardly extending bristles. The scrubbing brush has a passage therein extending between the elongate portion and the agitating head. The agitating head has a plurality of apertures into the passage of the scrubbing brush. One end of a flexible hose is detachably coupled to an end of the scrubbing brush to fluidly connect the hose to the passage of the scrubbing brush. The other end of the hose has a shower head connector to fluidly connect this end of the hose to a shower head.

11 Claims, 2 Drawing Sheets

SHOWER HEAD CLEANING ATTACHMENT

BACKGROUND OF THE INVENTION

1. Field of the Invention

The present invention relates to shower head cleaning attachments and more particularly pertains to a new shower head cleaning attachment for attachment to a shower head to permit cleaning therewith of a bathtub or shower stall.

2. Description of the Prior Art

The use of shower head cleaning attachments is known in the prior art. More specifically, shower bead cleaning attachments heretofore devised and utilized are known to consist basically of familiar, expected and obvious structural configurations, notwithstanding the myriad of designs encompassed by the crowded prior art which have been developed for the fulfillment of countless objectives and requirements.

Known prior art shower head cleaning attachments include U.S. Pat. No. 5,241,714 by Barry; U.S. Pat. No. 5,014,919 by Knapp; U.S. Pat. No. Des. 346,426 by Warshawsky; U.S. Pat. No. 5,033,897 by Chen; U.S. Pat. No. 5,090,624 by Rogers; and U.S. Pat. No. 5,102,387 by Jorde which herein are all incorporated by reference.

While these devices fulfill their respective, particular objectives and requirements, the aforementioned patents do not disclose a new shower head cleaning attachment. The inventive device includes a scrubbing brush with an elongate portion and an agitating head with a plurality of outwardly extending bristles. The scrubbing brush has a passage therein extending between the elongate portion and the agitating head. The agitating head has a plurality of apertures into the passage of the scrubbing brush. One end of a flexible hose is detachably coupled to an end of the scrubbing brush to fluidly connect the hose to the passage of the scrubbing brush. The other end of the hose has a shower head connector to fluidly connect this end of the hose to a shower head.

In these respects, the shower head cleaning attachment according to the present invention substantially departs from the conventional concepts and designs of the prior art, and in so doing provides an apparatus primarily developed for the purpose of attachment to a shower head to permit cleaning therewith of a bathtub or shower stall.

SUMMARY OF THE INVENTION

In view of the foregoing disadvantages inherent in the known types of shower head cleaning attachments now present in the prior art, the present invention provides a new shower head cleaning attachment construction wherein the same can be utilized for attachment to a shower head to permit cleaning therewith of a bathtub or shower stall.

The general purpose of the present invention, which will be described subsequently in greater detail, is to provide a new shower head cleaning attachment apparatus and method which has many of the advantages of the shower head cleaning attachments mentioned heretofore and many novel features that result in a new shower head cleaning attachment which is not anticipated, rendered obvious, suggested, or even implied by any of the prior art shower head cleaning attachments, either alone or in any combination thereof.

To attain this, the present invention generally comprises a scrubbing brush with an elongate portion and an agitating head with a plurality of outwardly extending bristles. The scrubbing brush has a passage therein extending between the elongate portion and the agitating head. The agitating head has a plurality of apertures into the passage of the scrubbing brush. One end of a flexible hose is detachably coupled to an end of the scrubbing brush to fluidly connect the hose to the passage of the scrubbing brush. The other end of the hose has a shower head connector to fluidly connect this end of the hose to a shower head.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shower head cleaning attachment apparatus and method which has many of the advantages of the shower head cleaning attachments mentioned heretofore and many novel features that result in a new shower head cleaning attachment which is not anticipated, rendered obvious, suggested, or even implied by any of the prior art shower head cleaning attachments, either alone or in any combination thereof.

It is another object of the present invention to provide a new shower head cleaning attachment which may be easily and efficiently manufactured and marketed.

It is a further object of the present invention to provide a new shower head cleaning attachment which is of a durable and reliable construction.

An even further object of the present invention is to provide a new shower head cleaning attachment which is susceptible of a low cost of manufacture with regard to both materials and labor, and which accordingly is then susceptible of low prices of sale to the consuming public, thereby making such shower head cleaning attachment economically available to the buying public.

Still yet another object of the present invention is to provide a new shower head cleaning attachment which provides in the apparatuses and methods of the prior art some of the advantages thereof, while simultaneously overcoming some of the disadvantages normally associated therewith.

Still another object of the present invention is to provide a new shower head cleaning attachment for attachment to a shower head to permit cleaning therewith of a bathtub or shower stall.

Yet another object of the present invention is to provide a new shower head cleaning attachment which includes a scrubbing brush with an elongate portion and an agitating head with a plurality of outwardly extending bristles. The scrubbing brush has a passage therein extending between the elongate portion and the agitating head. The agitating head has a plurality of apertures into the passage of the scrubbing brush. One end of a flexible hose is detachably coupled to an end of the scrubbing brush to fluidly connect the hose to the passage of the scrubbing brush. The other end of the hose has a shower head connector to fluidly connect this end of the hose to a shower head.

Still yet another object of the present invention is to provide a new shower head cleaning attachment that permits scrubbing of a shower surface with a mixture of water and cleaning solution coming out of a brush head.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
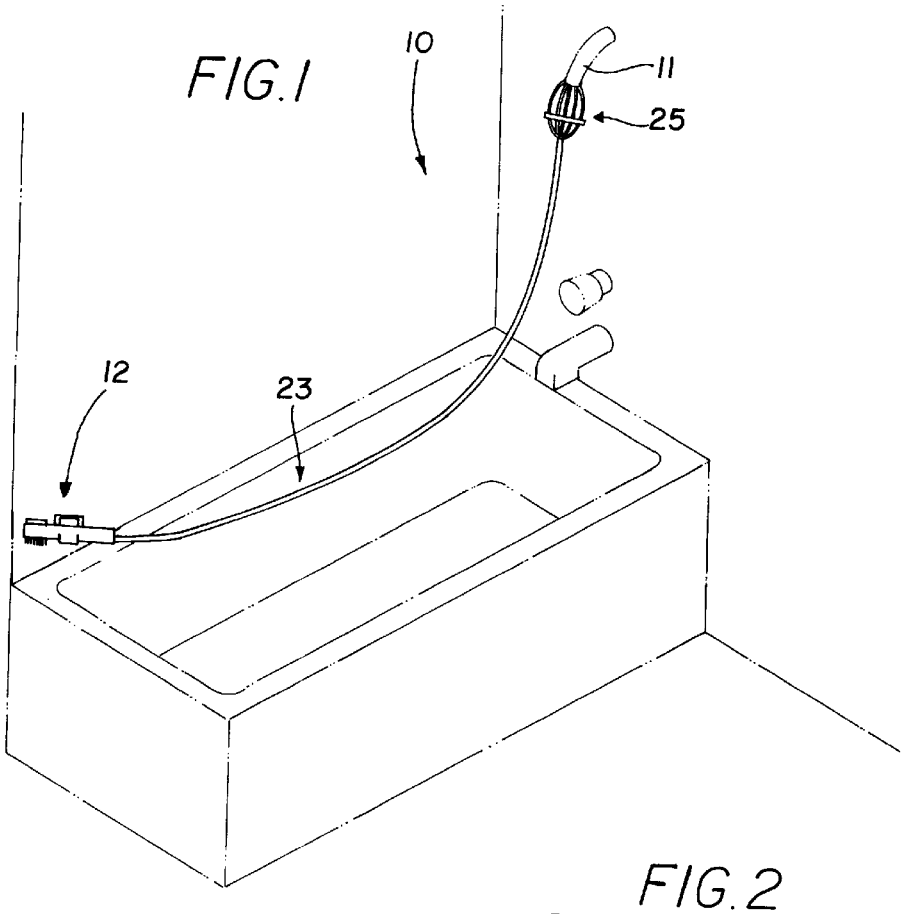
FIG. 1 is a schematic perspective view of a new shower head cleaning attachment in use according to the present invention.

With reference now to the drawings, and in particular to FIGS. 1 through 4 thereof, a new shower head cleaning attachment embodying the principles and concepts of the present invention and generally designated by the reference numeral 10 will be described.

As best illustrated in FIGS. 1 through 4, the shower head cleaning attachment 10 comprises a scrubbing brush with an elongate portion and an agitating head with a plurality of outwardly extending bristles. The scrubbing brush has a passage therein extending between the elongate portion and the agitating head. The agitating head has a plurality of apertures into the passage of the scrubbing brush. One end of a flexible hose is detachably coupled to an end of the scrubbing brush to fluidly connect the hose to the passage of the scrubbing brush. The other end of the hose has a shower head connector to fluidly connect this end of the hose to a shower head.

In closer detail, the cleaning attachment 10 is designed for attachment to a shower head 11 of a shower structure such as a shower stall or a bathtub outwardly extending from a vertical wall surface and fluidly connected to a water supply. Specifically the cleaning attachment comprises a generally hollow scrubbing brush 12 having opposite proximal and distal ends 13,14, a generally cylindrical tubular elongate portion 15, and an agitating head 16. The elongate portion of the scrubbing brush is positioned adjacent the proximal end of the scrubbing brush and the agitating head is positioned adjacent the distal end of the scrubbing brush.

The agitating head has a plurality of outwardly extending bristles 17 designed for scrubbing a surface of a shower structure. In an ideal embodiment, the bristles of the agitating head may be powered to rotate in a circular or an eccentric manner by a rotating device provided in the scrubbing brush. This rotating device is of the types commonly known in the art such as water powered rotation of a paddlewheel in the shower head coupled to a rotating base in the agitating head on which the bristles are mounted or a battery powered motor has a rotating shaft coupled to the rotating base on which the bristles of the agitating head to rotate the agitating head. In such embodiments, the agitating head of the scrubbing brush preferably has an outwardly extending battery compartment 18 opposite the bristles of the agitating head. The battery compartment is designed for holding therein at least one battery electrically connected to the motor and has an access panel 19 to provide access therein. Preferably, the battery compartment has push-button actuator 20 of a switch electrically connected to the motor to selectively energize the motor with the power from the batteries. The push button actuator preferably outwardly extends therefrom in a direction towards the proximal end of the scrubbing brush and is spring biased in the outwards direction towards the proximal end of the scrubbing brush.

Figure 2:
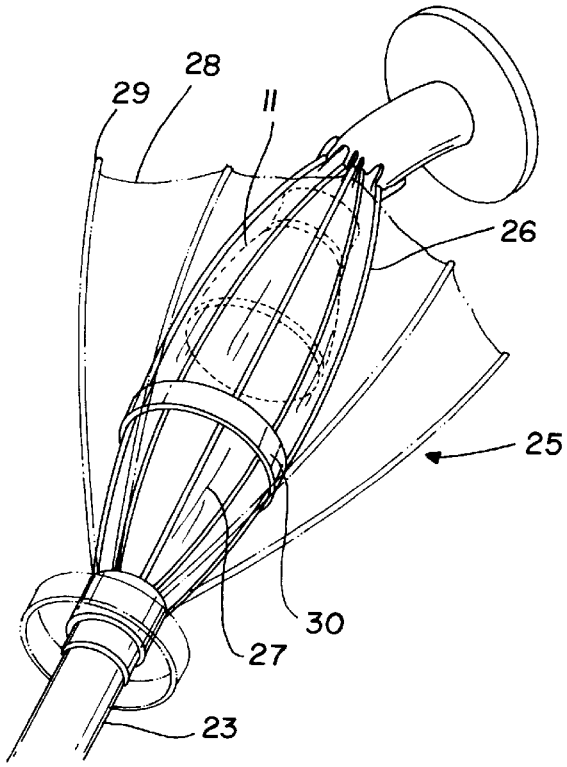
FIG. 2 is a schematic perspective view illustrating the attachment of the shower head connector of the present invention around a shower head.
Figure 3:
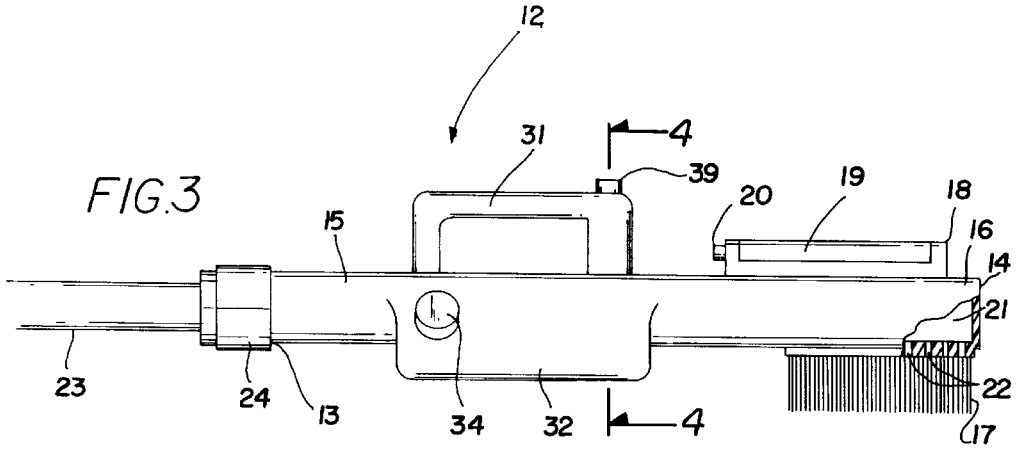
FIG. 3 is a schematic side view of the scrubbing brush of the present invention.

The scrubbing brush has a passage 21 therein extending between the elongate portion and the agitating head. The proximal end of the scrubbing brush has an opening into the passage. The agitating head also has a plurality of apertures 22 into the passage of the scrubbing brush which are interspersed amongst the bristles of the agitating head. An elongate flexible hose 23 fluidly connects the passage of the scrubbing brush to the shower head to permit passage of water from the shower head to the passage of the scrubbing handle. The hose has a pair of opposite open ends. A first of the ends of the hose is detachably coupled by a threaded connector ring 24 to the proximal end of the scrubbing brush to fluidly connect the hose to the passage of the scrubbing brush. A second of the ends of the hose has a shower head connector 25 designed for connecting the second end of the hose to a shower head. The shower head connector comprises a plurality of resilient elongate ribs 26 outwardly radiating from the second end of the hose and a generally umbrella-shaped flexible canopy 27 covering the ribs and is coupled to the second end of the hose. The canopy preferably comprises a flexible rubber material. The canopy of the shower head connector defines an inner cavity designed for receiving the shower head therein as illustrated in FIG. 2. The canopy has a generally circular outer edge 28 defining an opening into the inner cavity. The ribs of the shower head connector each have a tip 29 outwardly extending from the outer edge of the canopy. In use, the shower head is inserted into the inner cavity of the canopy such that the canopy covers the shower head. A coupling ring 30 is disposed around the canopy and the shower head to hold the shower head in the inner cavity of the canopy such that the coupling ring forms a substantially water-tight seal between the canopy and the shower head, the coupling ring deflecting the ribs towards the shower head such that the ribs help hold the shower head in the inner cavity of the canopy. As best illustrated in FIG. 2, the coupling ring is slidable off of the canopy and towards the hose to open the canopy and the ribs to permit releasing of the shower head from inside the inner cavity.

The scrubbing brush preferably has a generally rectangular U-shaped handle 31 outwardly extending from the elongate portion of the scrubbing brush. The handle is designed for grasping with a user's hand. Preferably, the handle and the battery compartment are positioned on the same side of the scrubbing brush. In this preferred embodiment, the elongate portion of the scrubbing brush has an enlarged portion forming an outwardly extending cleaner compartment 32 opposite the handle. The cleaner compartment defines a reservoir 33 for holding a cleaning fluid or detergent therein. The cleaner compartment has a filling opening into the reservoir of the cleaner compartment to permit filling of the reservoir with cleaning fluid with a cap 34 threaded onto the cleaner compartment to substantially close the filing opening.

Figure 4:
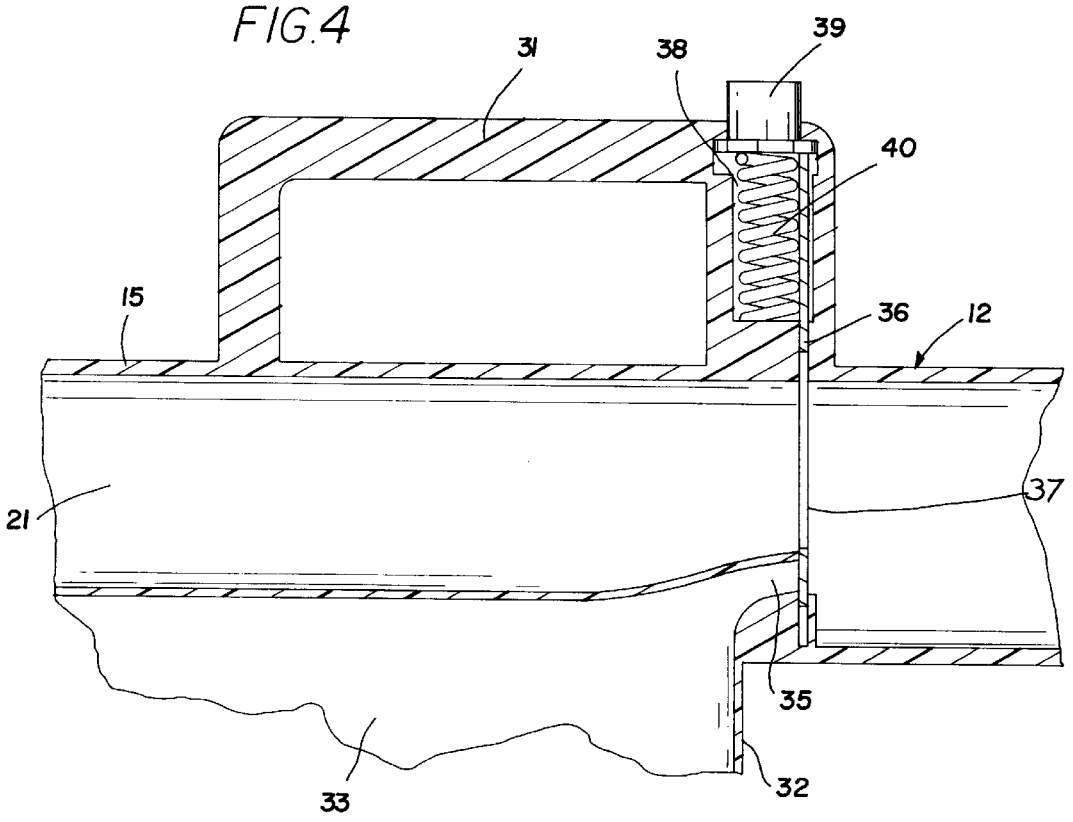
FIG. 4 is a schematic cross sectional view of the scrubbing brush taken from line 4—4 of FIG. 3.

As best illustrated in FIG. 4, the cleaner compartment has a spout 35 in the scrubbing brush fluidly connecting the reservoir of the cleaner to the passage of the scrubbing brush so that the cleaning fluid in the reservoir of the cleaner compartment may mix with the water from the shower head flowing into the passage of the scrubbing brush. The spout has a closure for selectively opening and closing passage of cleaner fluid from the spout of the cleaner compartment to the passage. Preferably, the closure of the spout comprises a plate 36 slidably mounted in the elongate portion of the scrubbing head. The plate has an opening 37 therethrough. The opening is positioned in the passage of the scrubbing brush to permit passing of fluid in the passage through the first opening of the plate. In use, the plate is slidable between an open position and a closed position. The plate substantially closes the spout when the plate is positioned in the closed position. When the plate is positioned in the open position, a portion of the opening of the plate is positioned adjacent the spout to permit passing of fluid from the spout into the passage of the scrubbing brush through the portion of the opening of the plate.

The plate has an end portion extending into the handle of the scrubbing head. The handle has a bore 38 therein into which the end portion of the plate extends. The handle has a release button 39 disposed in the bore of the handle. The release button is coupled to the end portion of the plate. In use, depression of the release button into the bore pushes on the end portion of the plate to slide the plate from the closed position to the open position. A spring 40 is provided in the bore of the handle and abuts the release button to bias the release button away from the elongate portion of the scrubbing brush and thereby bias the plate towards the closed position.

In use, the bristles of the scrubbing brush are used to scrub the surfaces of a shower structure to clean dirt and stains from the surfaces of the shower structure. Water from the shower head flows out of the scrubbing brush mixed with cleaning fluid from the reservoir of the cleaner compartment to aid the removal of dirt and stains when scrubbing with the bristles.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cleaning attachment for fluidly connecting to a shower head, said cleaning attachment comprising:

a scrubbing brush having opposite proximal and distal ends, a generally cylindrical tubular elongate portion, and an agitating head;

said elongate portion of said scrubbing brush being positioned adjacent said proximal end of said scrubbing brush, said agitating head being positioned adjacent said distal end of said scrubbing brush;

said agitating head having a plurality of outwardly extending bristles;

said scrubbing brush having a passage therein extending between said elongate portion and said agitating head; said proximal end of said scrubbing brush having an opening into said passage;

said agitating head having a plurality of apertures into said passage of said scrubbing brush, said apertures of said agitating head being positioned adjacent said bristles of said agitating head;

an elongate flexible hose having a pair of opposite open ends, a first of said ends of said hose being detachably coupled to said proximal end of said scrubbing brush to fluidly connect said hose to said passage of said scrubbing brush;

a second of said ends of said hose having a shower head connector, said shower head connector comprising a plurality of resilient elongate ribs outwardly radiating from said second end of said hose, and a generally umbrella-shaped flexible canopy covering said ribs and being coupled to said second end of said hose; and a coupling ring being disposed around said canopy and said shower head for holding a shower head in an inner cavity formed by said canopy.

2. The cleaning attachment of claim 1, wherein said agitating head of said scrubbing brush has an outwardly extending battery compartment opposite said bristles of said agitating head.

3. The cleaning attachment of claim 2, wherein said battery compartment has push-button actuator outwardly extending therefrom in a direction towards said proximal end of said scrubbing brush.

4. The cleaning attachment of claim 1, wherein said canopy has a generally circular outer edge, and wherein said ribs of said shower head connector each have a tip outwardly extending from said outer edge of said canopy.

5. The cleaning attachment of claim 1, wherein said scrubbing brush has a generally rectangular U-shaped handle outwardly extending from said elongate portion of said scrubbing brush.

6. The cleaning attachment of claim 5, wherein said elongate portion of said scrubbing brush has an outwardly extending cleaner compartment, said cleaner compartment defining a reservoir for holding a fluid therein, said cleaner compartment having a spout in said scrubbing brush fluidly connecting said reservoir of said cleaner compartment to said passage of said scrubbing brush.

7. The cleaning attachment of claim 6, wherein said cleaner compartment has a filling opening into said reservoir of said cleaner compartment, said cleaner compartment having a cap substantially closing said filing opening.

8. The cleaning attachment of claim 6, wherein said spout having a closure for selectively opening and closing said spout of said cleaner compartment.

9. The cleaning attachment of claim 8, wherein said closure of said spout comprises a plate slidably mounted in said scrubbing brush, said plate having an opening therethrough, said opening being positioned in said passage of said scrubbing brush to permit passing of fluid in said passage through said opening of said plate, said plate being slidable between an open position and a closed position, wherein said plate substantially closes said spout when said plate is positioned in said closed position, wherein a portion of said opening of said plate is positioned adjacent said spout when said plate is positioned in said open position to permit passing of fluid from said spout into said passage of said scrubbing brush through said portion of said opening of said plate.

10. The cleaning attachment of claim 9, wherein said plate has an end portion extending into said handle of said scrubbing brush, said handle having a bore therein, said end portion of said plate being extended into said bore, said handle having a release button disposed in said bore of said handle, said release button being coupled to said end portion of said plate, wherein a spring is provided in said bore of said handle and abuts said release button to bias said plate towards said closed position.

11. A cleaning attachment system, comprising:

a shower head fluidly connected to a water supply;

a scrubbing brush having opposite proximal and distal ends, a generally cylindrical tubular elongate portion, and an agitating head;

said elongate portion of said scrubbing brush being positioned adjacent said proximal end of said scrubbing brush, said agitating head being positioned adjacent said distal end of said scrubbing brush;

said agitating head having a plurality of outwardly extending bristles;

said agitating head of said scrubbing brush having an outwardly extending battery compartment opposite said bristles of said agitating head, said battery compartment being adapted for holding therein at least one battery;

said battery compartment having push-button actuator outwardly extending therefrom in a direction towards said proximal end of said scrubbing brush;

said scrubbing brush having a passage therein extending between said elongate portion and said agitating head; said proximal end of said scrubbing brush having an opening into said passage;

said agitating head having a plurality of apertures into said passage of said scrubbing brush, said apertures of said agitating head being positioned adjacent said bristles of said agitating head;

an elongate flexible hose fluidly connecting said passage of said scrubbing brush to said shower head to permit passage of water from said shower head to said passage of said scrubbing brush, said hose having an opposite pair of open ends, a first of said ends of said hose being detachably coupled to said proximal end of said scrubbing brush to fluidly connect said hose to said passage of said scrubbing brush;

a second of said ends of said hose having a shower head connector, said shower head connector comprising a plurality of resilient elongate ribs outwardly radiating from said second end of said hose, and a generally umbrella-shaped flexible canopy covering said ribs and being coupled to said second end of said hose;

said canopy comprising a flexible rubber material;

said canopy of said shower head connector defining an inner cavity, said canopy having a generally circular outer edge, said ribs of said shower head connector each having a tip outwardly extending from said outer edge of said canopy;

said shower head being inserted into said inner cavity of said canopy such that said canopy covers said shower head;

a coupling ring being disposed around said canopy and said shower head to hold said shower head in said inner cavity of said canopy, said coupling ring deflecting said ribs towards said shower head such that said ribs help hold said shower head in said inner cavity of said canopy;

said scrubbing brush having a generally rectangular U-shaped handle outwardly extending from said elongate portion of said scrubbing brush;

said elongate portion of said scrubbing brush having an outwardly extending cleaner compartment opposite said handle, said cleaner compartment defining a reservoir for holding a fluid therein;

said cleaner compartment having a filling opening into said reservoir of said cleaner compartment, said cleaner compartment having a cap substantially closing said filing opening;

said cleaner compartment having a spout in said scrubbing brush fluidly connecting said reservoir of said cleaners compartment to said passage of said scrubbing brush;

said spout having a closure for selectively opening and closing said spout of said cleaner compartment;

said closure of said spout comprising a plate slidably mounted in said scrubbing brush, said plate having an opening therethrough, said opening being positioned in said passage of said scrubbing brush to permit passing of fluid in said passage through said opening of said plate;

said plate being slidable between an open position and a closed position, wherein said plate substantially closes said spout when said plate is positioned in said closed position, wherein a portion of said opening of said plate is positioned adjacent said spout when said plate is positioned in said open position to permit passing of fluid from said spout into said passage of said scrubbing brush through said portion of said opening of said plate;

said plate having an end portion extending into said handle of said scrubbing brush;

said handle having a bore therein, said end portion of said plate being extended into said bore;

said handle having a release button disposed in said bore of said handle, said release button being coupled to said end portion of said plate; and wherein a spring is provided in said bore of said handle and abuts said release button to bias said plate towards said closed position.

* * * * *